US010125486B1

(12) United States Patent
Handley

(10) Patent No.: US 10,125,486 B1
(45) Date of Patent: Nov. 13, 2018

(54) DEFLECTION SHIELD SYSTEM

(71) Applicant: Toni Bill Handley, Midland, TX (US)

(72) Inventor: Toni Bill Handley, Midland, TX (US)

( * ) Notice: Subject to any disclaimer, the term of this patent is extended or adjusted under 35 U.S.C. 154(b) by 0 days.

(21) Appl. No.: 15/826,352

(22) Filed: Nov. 29, 2017

(51) Int. Cl.

| | |
|---|---|
| ***E04B 2/74*** | (2006.01) |
| ***F41H 5/08*** | (2006.01) |
| ***F41H 5/14*** | (2006.01) |
| ***F41H 5/18*** | (2006.01) |
| ***E04B 1/344*** | (2006.01) |
| ***E04H 9/06*** | (2006.01) |
| ***E04H 15/48*** | (2006.01) |

(52) U.S. Cl.
CPC ..... *E04B 1/3445* (2013.01); *E04B 1/344* (2013.01); *E04B 2/7425* (2013.01); *E04B 2/7427* (2013.01); *E04B 2/7431* (2013.01); *E04H 9/06* (2013.01); *E04H 15/48* (2013.01); *F41H 5/08* (2013.01); *F41H 5/14* (2013.01); *F41H 5/18* (2013.01)

(58) Field of Classification Search
CPC ..... F41H 5/18; F41H 5/08; F41H 5/14; E04B 1/344; E04B 1/3445; E04B 1/3444; E04B 2/7425; E04B 2/7427; E04B 2/7431; E04H 15/48
See application file for complete search history.

(56) References Cited

U.S. PATENT DOCUMENTS 421,034 A * 2/1890 Shuck ..... E04B 1/3445 52/70
4,726,155 A * 2/1988 Nahmias ..... E04B 1/344 52/71
5,966,777 A * 10/1999 Jantschek ..... E04B 2/7431 16/354
6,009,930 A * 1/2000 Jantschek ..... A47G 5/00 160/135
7,213,632 B1 * 5/2007 Goldstein ..... A47G 5/00 160/135
7,735,537 B2 * 6/2010 Hardt, II ..... E04B 2/7427 16/44
8,857,496 B2 * 10/2014 Raniere ..... E04B 2/7405 160/135
9,675,720 B2 * 6/2017 Romo ..... A61L 2/10
2005/0223665 A1 * 10/2005 Maas ..... E04B 2/7427 52/239
2008/0086964 A1 * 4/2008 Hardt ..... E04B 2/7427 52/239
2008/0178543 A1 * 7/2008 Maas ..... E04B 2/7425 52/234

(Continued)

*Primary Examiner* — Adriana Figueroa
*Assistant Examiner* — Jessie T Fonseca
(74) *Attorney, Agent, or Firm* — Plager Schack LLP; Mark H. Plager; Michael O'Brien

(57) ABSTRACT

A deflection system is configured to deflect munitions fired at a room. The deflection system includes a first panel, rotationally attached to a first jamb. A second panel is attached to the first jam and further rotationally attached to a second jamb. A third panel is attached to the second jamb, and further rotationally attached to a fourth panel. A third jamb is attached to the fourth panel and further rotationally attached to a fifth panel. A fourth jamb is attached to the fifth panel, and further rotationally attached to a sixth panel. Attaching the third panel to a door frame near the room enables a user to rotate the fourth panel, the fifth panel and the sixth panel to deflect the munitions fired at the room.

3 Claims, 4 Drawing Sheets

(56) References Cited

U.S. PATENT DOCUMENTS

| | | | | |
|---|---|---|---|---|
| 2010/0051211 | A1* | 3/2010 | Chen | E04B 2/7427 160/135 |
| 2010/0132895 | A1* | 6/2010 | Logue | A47B 46/005 160/127 |
| 2012/0168097 | A1* | 7/2012 | Gilbert | A47G 5/00 160/130 |
| 2013/0186023 | A1* | 7/2013 | Nobile | E04B 2/7427 52/242 |
| 2013/0260362 | A1* | 10/2013 | Melashenko | G09B 19/00 434/430 |
| 2014/0138035 | A1* | 5/2014 | Potter | E04B 2/7427 160/135 |
| 2014/0216239 | A1* | 8/2014 | White | F41H 5/08 89/36.02 |
| 2015/0096479 | A1* | 4/2015 | McCarthy | F41H 5/04 109/1 S |

* cited by examiner

DEFLECTION SHIELD SYSTEM

BACKGROUND

The embodiments herein relate generally to devices for defense in an active shooter situation.

Prior to embodiments of the disclosed invention, surviving an active shooter situation was challenging. Embodiments of the disclosed invention solve that problem.

SUMMARY

A deflection system is configured to deflect munitions fired at a room. The deflection system includes a first panel, rotationally attached to a first jamb. A second panel is attached to the first jam and further rotationally attached to a second jamb. A third panel is attached to the second jamb, and further rotationally attached to a fourth panel. A third jamb is attached to the fourth panel and further rotationally attached to a fifth panel. A fourth jamb is attached to the fifth panel, and further rotationally attached to a sixth panel. Attaching the third panel to a door frame near the room enables a user to rotate the fourth panel, the fifth panel and the sixth panel to deflect the munitions fired at the room.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
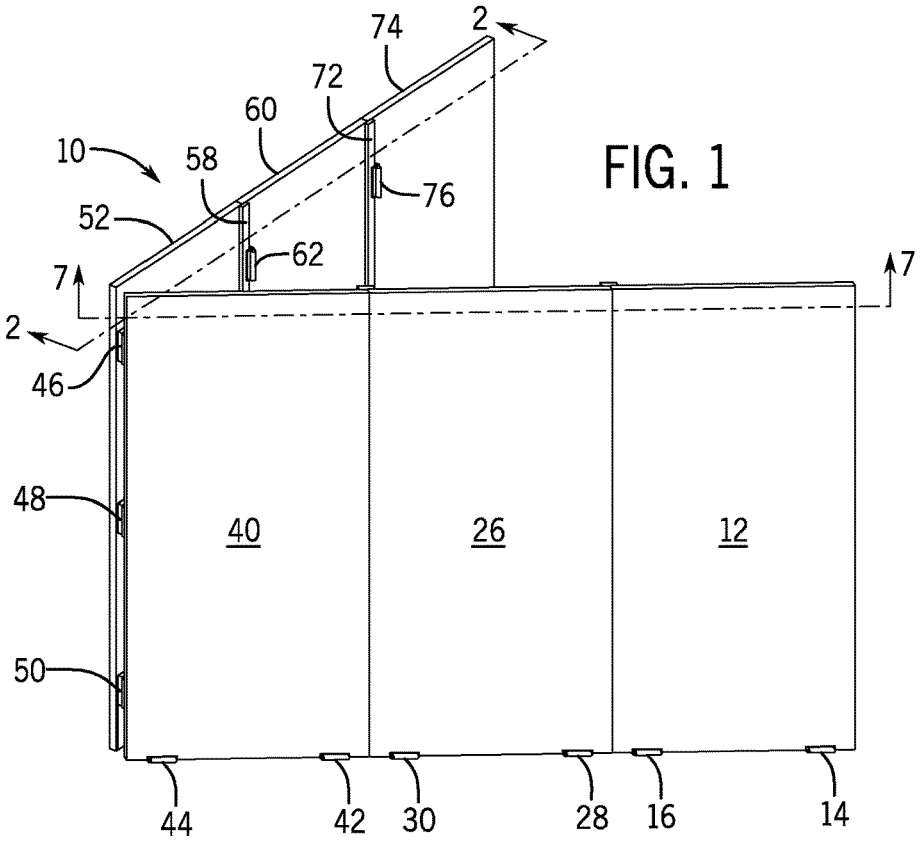
FIG. 1 shows a perspective view of one embodiment of the present invention.
Figure 2:
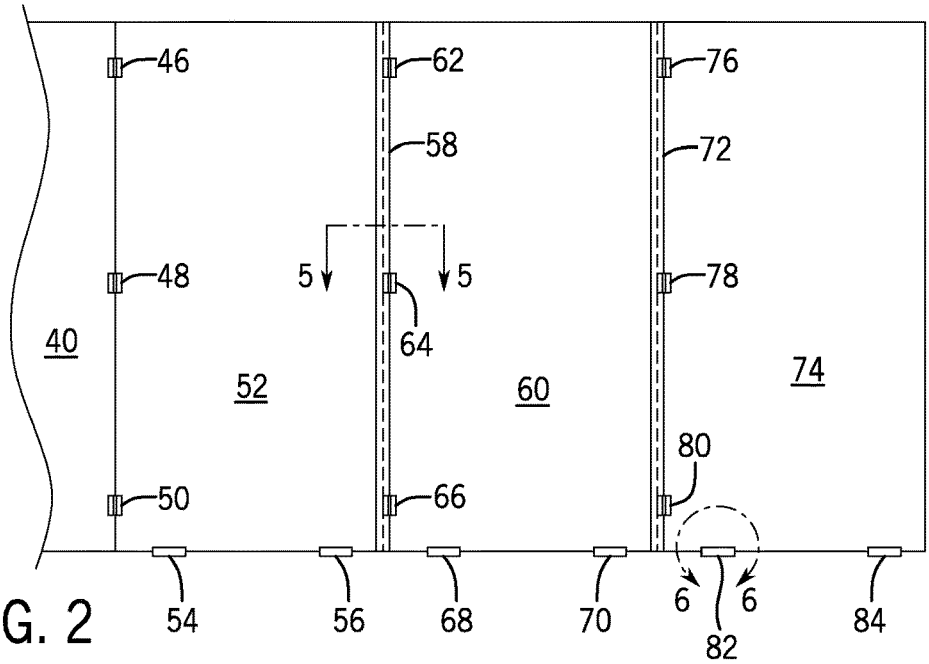
FIG. 2 shows a section view of one embodiment of the present invention taken along line 2-2 in FIG. 1.

By way of example, and referring to FIG. 1, one embodiment of a deflection shield system 10 further comprises a first panel 12. The first panel 12 is attached to a first panel first roller 14 and a first panel second roller 16. The first panel 12 is further attached to a first jamb 18 with a first upper hinge 20, a first middle hinge 22 and a first lower hinge 24.

The first jamb 18 is further attached to a second panel 26. The second panel 26 is further attached to a second panel first roller 28 and a second panel second roller 30. The second panel 26 is further attached to a second jamb 32 with a second upper hinge 34, a second middle hinge 36 and a second lower hinge 38.

The second jamb 32 is further attached to a third panel 40. The third panel 40 is further attached to a third panel first roller 42 and a third panel second roller 44. The third panel 40 is further attached to a third upper hinge 46, a third middle hinge 48 and a third lower hinge 50.

A fourth panel 52 is attached to the third upper hinge 46, the third middle hinge 48 and the third lower hinge 50. The fourth panel 52 is further attached to a fourth panel first roller 54 and a fourth panel second roller 56. The fourth panel 52 is further attached to a third jamb 58.

The third jamb 58 is further attached to a fifth panel 60 with a fourth upper hinge 62, a fourth middle hinge 64 and a fourth lower hinge 66. The fifth panel 60 is further attached to a fifth panel first roller 68 and a fifth panel second roller 70. The fifth panel is further attached to a fourth jamb 72.

The fourth jamb 72 is further attached to a sixth panel 74 with a fifth upper hinge 76, a fifth middle hinge 78 and a fifth lower hinge 80. The sixth panel 74 is further attached to a sixth panel first roller 82 and a sixth panel second roller 84.

Figure 3:
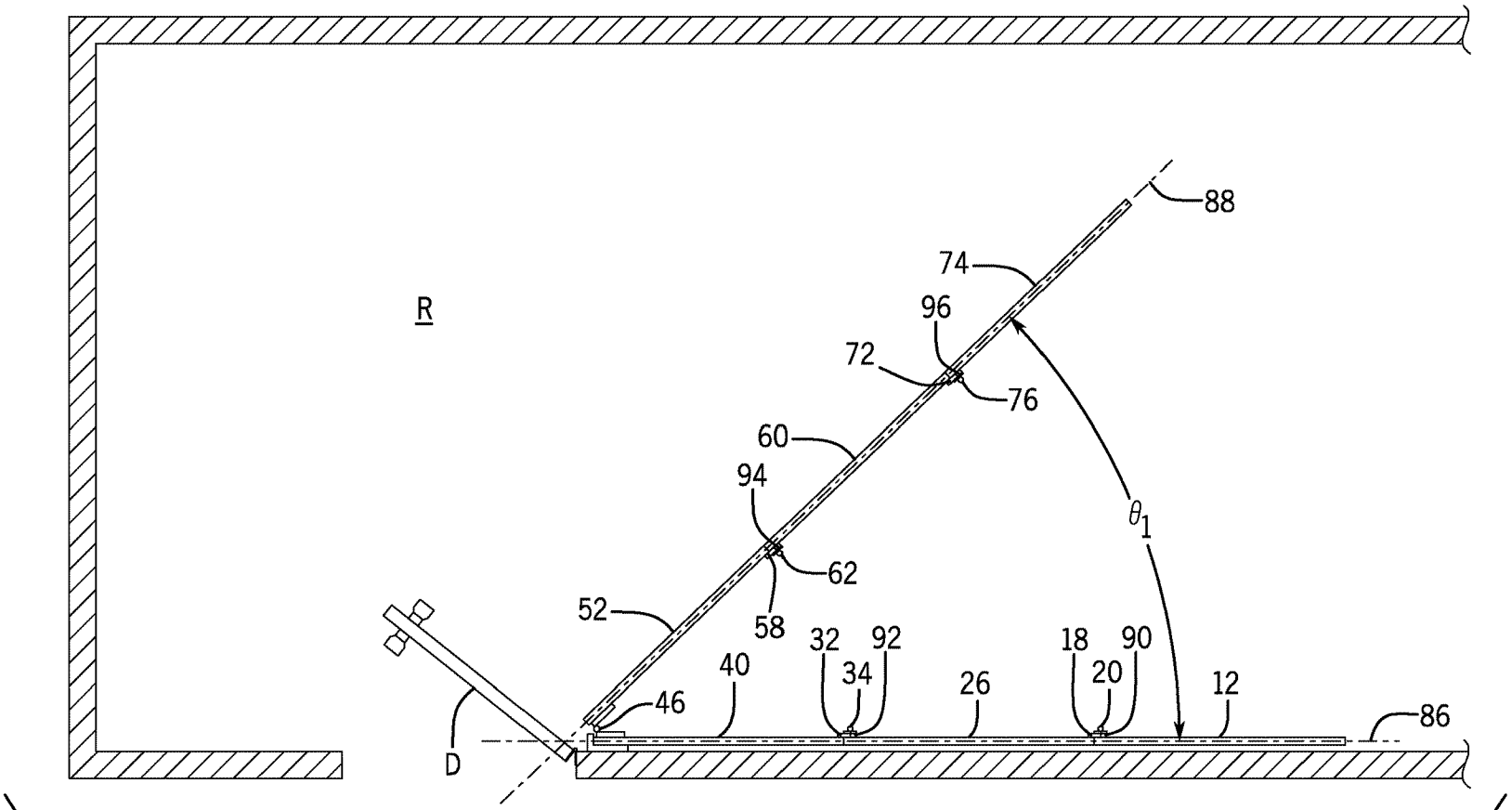
FIG. 3 shows a top view of one embodiment of the present invention shown in a first mode of operation.

Turning to FIG. 3, in some embodiments, the first panel 12, the second panel 26, the third panel 40, the fourth panel 52, the fifth panel 60 and the seventh panel 74 can be made from any variety of steel that is at least one quarter inch thick. These panels can be 7.5 to 9 feet wide and six feet tall.

Figure 4:
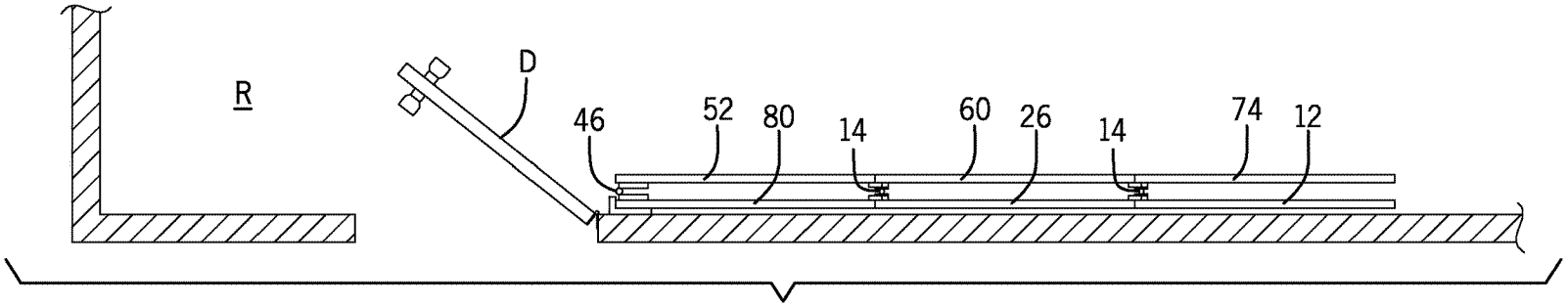
FIG. 4 shows a top view of one embodiment of the present invention shown in a second mode of operation.
Figure 5:
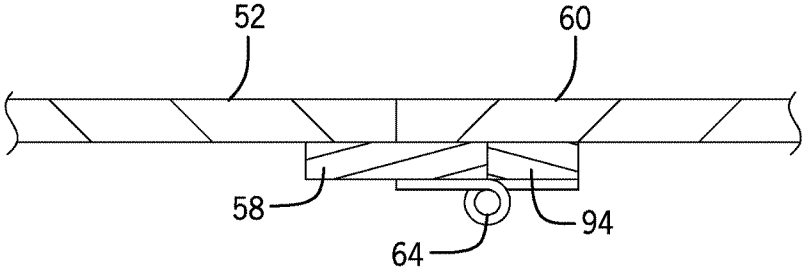
FIG. 5 shows a detail view of one embodiment of a hinge.
Figure 6:
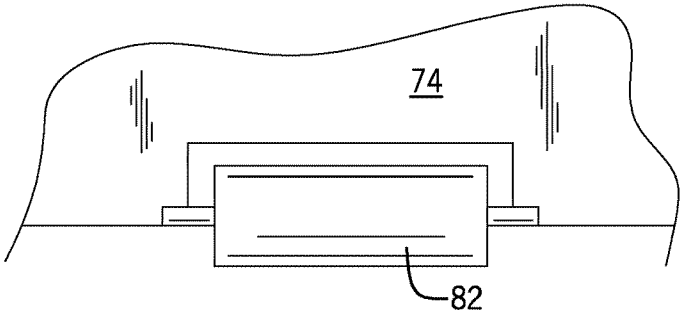
FIG. 6 shows a detail view of one embodiment of a roller.
Figure 7:
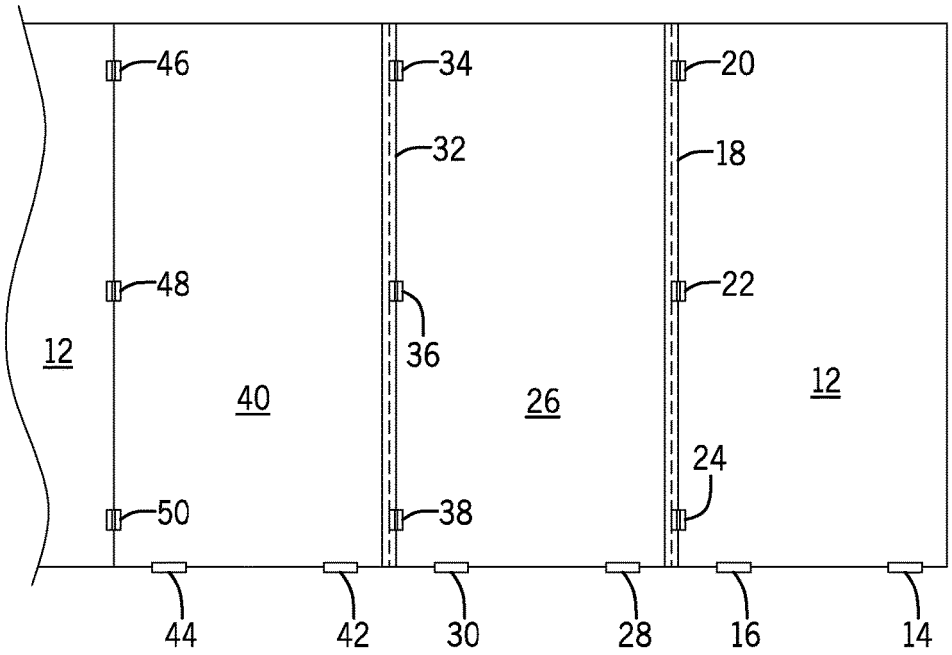
FIG. 7 shows a section view of one embodiment of the present invention taken along line 7-7 in FIG. 1.

To install the deflection shield system 10, the third panel 40 is mechanically coupled to a door frame F proximate a door D that provides access to a room R. It follows that the first panel 12, the second panel 26, the third panel 40 have top edges that are parallel to a first axis 86. Likewise, the fourth panel 52, the fifth panel 60 and the seventh panel 74 have top edges that are parallel to a second axis 88. A first angle θ1 can be measured counterclockwise from the first axis to the second axis. There are two modes of operation of the deflection shield system 10. In a first mode of operation, or a deployed mode of operation the first angle θ1 is between 25 and 30 degrees. This provides optimum coverage to deflect both bullets and shot. FIG. 4 shows a second mode of operation, or a collapsed mode of operation where the first angle is approximately zero.

The panels can be very heavy and, in some cases, require additional support. In that regard, the first upper hinge 20, the first middle hinge 22 and the first lower hinge 24 can be further attached to the first panel 12 with a first spacer 90. Likewise, the second upper hinge 34, the second middle hinge 36 can the second lower hinge 38 and be further attached to the second panel 26 with a second spacer 92. Similarly, the fourth upper hinge 62, the fourth middle hinge 64 and the fourth lower hinge 66 can be further attached to the fifth panel 60 with a third spacer 94. Finally, the fifth upper hinge 76, the fifth middle hinge 78 and the fifth lower hinge 80 can be attached to the sixth panel 74 with a fourth spacer 96.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A deflection system, configured to deflect munitions fired at a room; the deflection system comprising:

a first panel, rotationally attached to a first jamb; wherein the first panel further comprises a first panel first roller opening rectangularly recessed from a first panel lower edge and a first panel second roller opening rectangularly recessed from the first panel lower edge;

a first panel first roller, being cylindrical and having a first panel first roller axis arranged within the first panel first roller opening;

a first panel second roller, being cylindrical and having a first panel second roller axis arranged within the first panel second roller opening;

a second panel, attached to the first jamb and further rotationally attached to a second jamb;

third panel, attached to the second jamb, and further rotationally attached to a fourth panel;

a third jamb, attached to the fourth panel and further rotationally attached to a fifth panel;

a fourth jamb, attached to the fifth panel, and further rotationally attached to a sixth panel;

wherein attaching the third panel to a door frame near the room enables a user to rotate the fourth panel, the fifth panel and the sixth panel to deflect the munitions fired at the room wherein each panel is made from steel that is one quarter inch thick and six feet tall.

2. The deflection system of claim 1, further comprising:

a second panel first roller and a second panel second roller, attached to the second panel;

a third panel first roller and a third panel second roller, attached to the third panel;

a fourth panel first roller and a fourth panel second roller, attached to the fourth panel;

a fifth panel first roller and a fifth panel second roller, attached to the fifth panel; and a sixth panel first roller and a sixth panel second roller, attached to the sixth panel.

3. The deflection system of claim 2, wherein:

the first panel is rotationally attached to the first jamb with a first upper hinge, a first middle hinge, and a first lower hinge;

the second panel is further attached to a second jamb with a second upper hinge, a second middle hinge and a second lower hinge;

the third panel is rotationally attached to the fourth panel with a third upper hinge, a third middle hinge and a third lower hinge;

the fifth panel is rotationally attached to the third jamb with a fourth upper hinge, a fourth middle hinge and a fourth lower hinge;

the fifth panel is rotationally attached to the sixth panel with a fifth upper hinge, a fifth middle hinge, and a fifth lower hinge.

* * * * *